US007100849B2

(12) United States Patent
Bailey et al.

(10) Patent No.: US 7,100,849 B2
(45) Date of Patent: Sep. 5, 2006

(54) APPARATUS AND METHOD FOR POSITIONING ROAD MARKING MATERIAL APPLICATION EQUIPMENT USING HOLOGRAPHIC SIGHTS

(75) Inventors: Kevin D. Bailey, Allenwood, PA (US); Keith R. Bauer, Williamsport, PA (US)

(73) Assignee: M-E Companies, Inc. of Wisconsin, New Holstein, WI (US)

( * ) Notice: Subject to any disclaimer, the term of this patent is extended or adjusted under 35 U.S.C. 154(b) by 304 days.

(21) Appl. No.: 10/703,399

(22) Filed: Nov. 7, 2003

(65) Prior Publication Data

US 2005/0098668 A1 May 12, 2005

(51) Int. Cl.

| | |
|---|---|
| ***B05B 3/00*** | (2006.01) |
| ***B05B 3/18*** | (2006.01) |
| ***A01G 25/09*** | (2006.01) |
| ***A01G 27/00*** | (2006.01) |

(52) U.S. Cl. ..... 239/722; 239/731; 239/733; 239/146; 239/67; 239/68; 239/69; 239/70; 239/71; 239/73

(58) Field of Classification Search ..... 239/722, 239/731, 733, 146, 172, 67–71, 73, 1; 359/13, 359/14, 15, 630, 631

See application file for complete search history.

(56) References Cited

U.S. PATENT DOCUMENTS

| | | | | |
|---|---|---|---|---|
| 2,974,875 | A | 3/1961 | Brown | 239/150 |
| 4,219,092 | A * | 8/1980 | Richter | 378/45 |
| 4,592,654 | A | 6/1986 | Girault et al. | 356/247 |
| 5,144,459 | A * | 9/1992 | Felske et al. | 359/13 |
| 5,203,923 | A * | 4/1993 | Hartman | 118/669 |
| 5,483,362 | A | 1/1996 | Tai et al. | 359/1 |
| 5,574,579 | A * | 11/1996 | Molteni et al. | 359/23 |
| 6,439,473 | B1 | 8/2002 | Meyer et al. | 239/69 |
| 6,490,060 | B1 | 12/2002 | Tai et al. | 359/15 |

* cited by examiner

*Primary Examiner*—Davis Hwu
(74) *Attorney, Agent, or Firm*—Whyte Hirschboeck Dudek SC

(57) ABSTRACT

The present invention provides an apparatus and method for applying road marking material to a pavement surface. The apparatus includes a vehicle having a holographic sight and at least one road marking material applicator mounted thereon. In accordance with the method, an operator of the vehicle steers the vehicle to a desired position on the pavement surface based upon aiming information observable through the holographic sight.

20 Claims, 3 Drawing Sheets

APPARATUS AND METHOD FOR POSITIONING ROAD MARKING MATERIAL APPLICATION EQUIPMENT USING HOLOGRAPHIC SIGHTS

BACKGROUND OF THE INVENTION

1. Field of Invention

The present invention relates to road marking, and more particularly, to an apparatus and method for positioning road marking material application equipment using holographic sights.

2. Description of Related Art

Paint, thermoplastic, glass beads and other visually distinctive road marking material (hereinafter collectively referred to as "road marking material") is often applied to roadways, runways and other paved surfaces in the form of long lines and/or intermittent stripes that define visually perceptible lanes within which vehicles and/or pedestrians can safely travel. In most instances, the road marking material is applied by one or more applicators that are transported by a vehicle that passes over the pavement surface to be marked at relatively low speed. The applicators may be mounted to a trailer that is pulled by the vehicle or, more commonly, the vehicle comprises a flat bed truck onto which the road marking material applicators are mounted.

In order to insure that the applicators are oriented in the proper and desired location above the pavement surface to be marked, it is critical that the vehicle transporting the applicators be properly positioned on the paved surface. At least four systems are known in the art for assisting vehicle operators with the proper orientation of road marking vehicles on pavement surfaces, namely: mechanical sights; optical sights; laser projection; and camera sights. Unfortunately, each of these known systems presents certain disadvantages.

Mechanical sights simply consist of a long boom or arm that extends 10–15' away from the front of the vehicle and terminates in a tip that points downwardly toward the road surface. The boom is typically hydraulically activated. An operator of the vehicle makes steering adjustments to the vehicle in order to keep the tip of the boom pointed at a target line. Mechanical sights present at least two disadvantages. First, they extend a significant distance away from the vehicle, creating a potential traffic hazard. Second, they are not particularly accurate, and do not provide the operator with any relative reference point during use.

Optical sights are sometimes used as an alternative to mechanical sights. Optical sights employ the same basic technology as 1940's era military bomb sights. Such optical sights typically include at least one mirror, a lens and a metal reticle plate that is illuminated using an internal lighting device. An example of such an optical sight is disclosed in Brown, Jr., U.S. Pat. No. 2,974,875. Optical sights disadvantageously produce a parallax if the operator's eyes are not properly oriented with respect to the viewer. Accordingly, in order to produce accurate results, the vehicle operator must hold his or her head in the same position for extended periods of time, which causes operator fatigue and divides the operator's attention from the operation of the vehicle.

Laser projection is also sometimes used to assist operators with properly orienting vehicles transporting road marking material applicators over pavement surfaces. A laser line is projected from the vehicle to the road surface. The operator of the vehicle or equipment watches the laser mark projected on the ground, and simultaneously adjusts the position of the vehicle or equipment to maintain the laser mark on the desired target. The projected laser method is superior to mechanical and/or optical sights, at least in terms of improving operator comfort and reducing the degree to which the operator's attention is divided, but it suffers from several other disadvantages. One of the most significant disadvantages is that it is often difficult to see laser light on some types of paved surfaces, particularly in bright sunlight.

Video cameras are also sometimes used to assist operators in properly orienting road marking vehicles on pavement surfaces. A camera relays a video image to a monitor that is mounted within the cab of the vehicle. The operator of the vehicle adjusts the position of the vehicle with respect to the road until a target mark on the pavement is properly framed in the monitor. This method of aligning a vehicle on a paved surface to be marked is disadvantageous because it requires the installation of video monitors, which can be bulky in vehicle cabs, are prone to damage, and can be difficult to view in bright sunlight. Moreover, it requires that the operator of the vehicle to watch a video monitor instead of the roadway or the area around the vehicle, again disadvantageously dividing the operator's attention.

BRIEF SUMMARY OF THE INVENTION

The present invention provides an apparatus and method for applying road marking material to a pavement surface. The apparatus includes a vehicle having a holographic sight and at least one road marking material applicator mounted thereon. An operator steers the vehicle to a desired position on the pavement surface based upon aiming information observable through the holographic sight. The aiming information comprises a projected reticle pattern and a ground target ahead of the vehicle. The operator steers the vehicle until the ground target is properly aligned with the projected reticle pattern.

The present invention overcomes the limitations of the prior art. For example, the holographic sight does not require that the operator hold his or her head in a fixed position for extended periods of time. The projected reticle pattern is observable by the operator within a field of view that is preferably several inches wide. Furthermore, the holographic sight is preferably installed near the windshield of the vehicle, thus allowing the operator to simultaneously monitor the position of the vehicle and the driving conditions around it. In that sense, the holographic sight provides a "heads-up" display.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

The present invention provides a vehicle having a holographic sight and at least one road marking material applicator mounted thereon. The holographic sight is preferably mounted within a cab where an operator controls the movement of the vehicle. The operator can view a holographic reticle image and an intended target ahead of the vehicle through the holographic sight and can making steering adjustments to the vehicle to align the holographic reticle image with the intended target. The present invention advantageously allows the operator to properly position the road marking material applicators mounted to the vehicle properly with respect to the pavement surface being marked while at the same observing any potentially hazardous situations that may suddenly arise in the vicinity of the vehicle.

Figure 1:
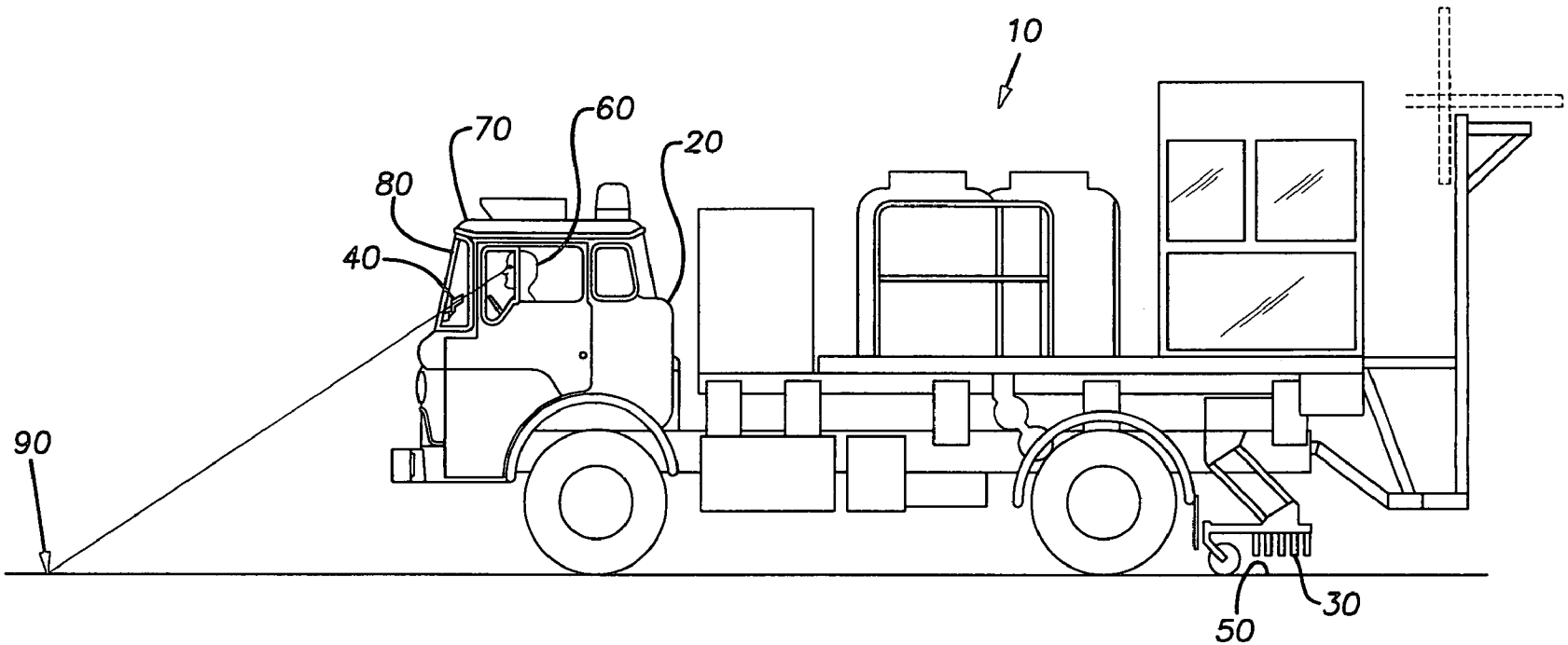
FIG. 1 shows a side plan view of an exemplary apparatus according to the invention.
Figure 2:
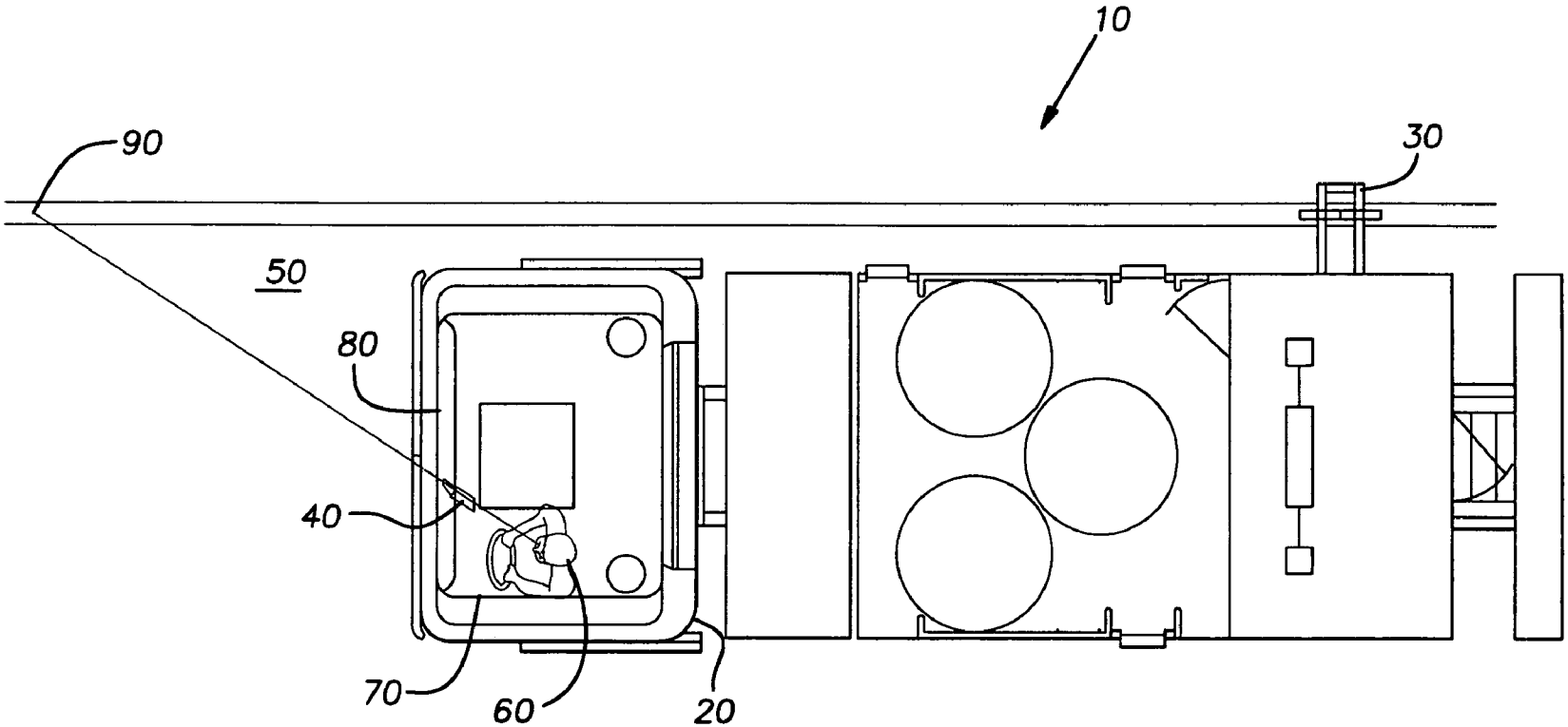
FIG. 2 shows top plan view of the exemplary apparatus shown in FIG. 1.

FIGS. 1 and 2 show a side plan view and a top plan view, respectively, of an exemplary apparatus 10 according to the invention. The apparatus 10 comprises a vehicle 20 having at least one road marking material applicator 30 mounted thereon, and a holographic sight 40 mounted to the vehicle 20. The vehicle 20 is preferably self-propelled. In the most preferred embodiment of the invention, the vehicle 20 comprises a flat bed truck onto which one or more applicators 30 are mounted. The road marking material applicators 30 mounted to the vehicle 20 can dispense paint, thermoplastic and/or glass beads to the pavement surface 50. Typically, several applicators 30 are mounted to the vehicle 20.

An operator 60 sits in a forward cab 70 of the vehicle 20 and controls the direction and speed of the vehicle 20. The holographic sight 40 is preferably mounted to a windshield 80 in front of the forward cab 70 or to some other portion of the vehicle 20 such that the holographic sight 40 is disposed between the operator 60 and the intended target 90. The holographic sight 40 can be battery powered, or it can draw power from the vehicle 20 or a generator powering one or more road marking material applicators 30.

To properly orient the vehicle 20 on the pavement surface 50, the operator 60 looks through a display window of the holographic sight 40 and aligns a holographic reticle image projected thereon with an intended target 90 applied to the pavement surface 50 ahead of the vehicle 20. The intended target 90 can be an old paint line that is being repainted or, alternatively, it can be a series of marks applied to the pavement surface 50 that each serve as an individual target for the operator 60 to align with the holographic reticle image observable in the display window of the holographic sight 40 as the vehicle passes along the pavement surface 50.

The intended target 90 can be situated ahead and to the right or left of the vehicle 20 as it passes along the pavement surface 50. Alternatively, the intended target can be situated directly ahead of the vehicle 20 as it passes along the pavement surface 50. The intended target 90 can be a permanent mark, such as an old line that is being repainted, or it can be a temporary mark applied solely for the purpose of properly aligning the apparatus 10 to accomplish the desired road marking operation. Thus, in one embodiment, the intended target comprises a mark that was applied to the pavement surface less than thirty days prior to the date when the road marking material is dispensed and in another embodiment, the intended target comprises a mark applied to the pavement surface thirty days or more prior to the date when the road marking material is dispensed.

As the vehicle 20 moves along the pavement surface 50, the road marking material applicator 30 dispenses road marking material onto the pavement surface at a desired location. In a preferred embodiment of the invention, the applicator 30 is operated by a second operator, who makes fine adjustments to the location of the applicator 30 with respect to the pavement surface 50.

Figure 3:
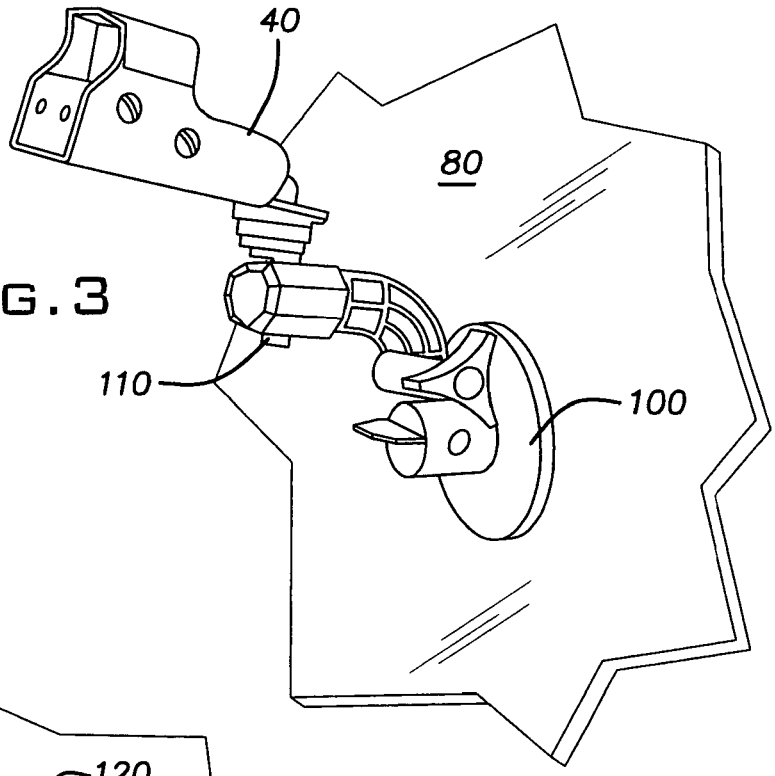
FIG. 3 shows a perspective view of a holographic sight mounted to a windshield of a vehicle.

FIG. 3 shows a perspective view of a holographic sight 40 mounted to a windshield 80 of a vehicle 20. In FIG. 3, the holographic sight 40 is aimed at an intended target 90 that is ahead and slightly to the left of the vehicle 20. As shown in FIG. 3, the holographic sight is removably mounted to the windshield 80 of the vehicle 20 using a suction cup 100. An adjustable arm 110 extends between the suction cup 100 and the holographic sight 40. The adjustable arm 110 facilitates positioning and calibration of the holographic sight 40. The operator 60 uses th suction cup 100 to attach the holographic sight 40 to a desired location on the windshield 80, and then adjusts the orientation of the holographic sight 40 until it is properly situated in a comfortable line of sight between the operator's eyes and the intended target 90 ah ad of the vehicle 20. Once the holographic sight is oriented in the desired location, the adjustable arm 110 is tightened so as to hold the holographic sight 40 in the desired orientation relative to the operator and intended target.

Figure 4:
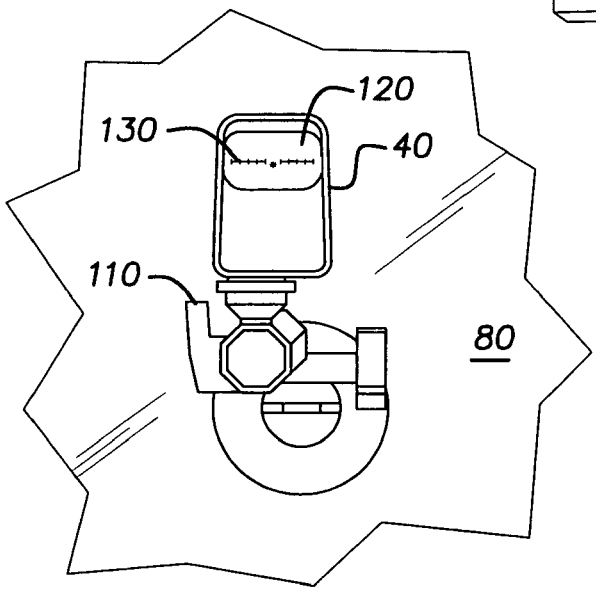
FIG. 4 shows the holographic sight shown in FIG. 3 taken from the perspective of a vehicle operator.

FIG. 4 shows the holographic sight 40 shown in FIG. 3 taken from the perspective of the operator 60. FIG. 4 shows that the holographic sight 40 obstructs only a very small portion of the operator's field of vision, although it will be appreciated that larger or smaller holographic sights can be used, if desired. FIG. 4 also shows the display window 120 onto which the holographic reticle image 130 is projected. Unlike mechanical sights and optical sights, the holographic reticle image is viewable by the operator over a range of positions, has no parallax, and thus allows the operator 60 to move his or her head position and still keep the target and holographic reticle image in sight. The holographic reticle image does not disappear in high or low light conditions. In fact, the holographic sight can be used at night. All of the information necessary to reconstruct the holographic reticle image is recorded everywhere in the display window 120 at all times. This permits the operator to view the holographic reticle image on different portions of the display window 120, even when parts thereof are obstructed.

Tai et al., U.S. Pat. Nos. 6,490,060 and 5,483,362, which are hereby incorporated by reference in their entirety, describe the construction and operation of holographic sights of the type shown in FIGS. 3 and 4. These holographic sights have been developed for use as aiming devices for small arms, such as rifles, shotguns, hand guns, bows and other hand-held weapons. Generally speaking, such holographic sights comprise a laser diode that emits a beam of visible wavelength light and a hologram of a reticle pattern mounted in the path of the beam to project a reticle pattern to a target plane. The holographic sight further comprises a collimitor mounted in the path of the beam to collimate the beam and direct the beam from the laser diode and a reflective diffraction grating mounted in the path of the collimited beam to diffract the beam and directed the diffracted beam to the hologram. The laser diode, hologram, collimitor and reflective diffraction grating are contained within a housing, which is secured to the windshield of the vehicle using a suction cup. The assignee of the Tai et al. patents, EOTech, Inc. of Ann Arbor, Mich., sells several models of holographic sights, including Model 502, which is presently most preferred for use in the invention.

Figure 5:
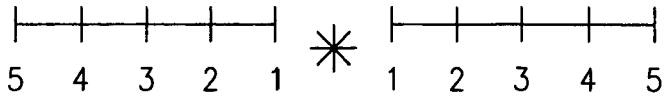
FIG. 5 shows an exemplary holographic reticle pattern.

The standard holographic reticle pattern in the Model 502 holographic sight can be used in the present invention. It consists of two rings that, once centered and placed on an intended target, confirm that the holographic sight is properly aimed at the intended target. More preferably, however, the projected holographic reticle pattern is identical or similar to that shown in FIG. 5. Because the intended target 90 is typically a long line, such as a sideline or centerline, which extends in what appears to be substantially vertical direction away from the operator, a holographic reticle pattern having a substantially horizontal appearance is desirable. The intended target (a substantially vertical line) and the horizontal holographic reticle image intersect as crosshairs, making alignment determinations very simple. Moreover, use of a wide, horizontal profile reticle with periodic interruptions as shown in FIG. 5 gives the operator the ability to judge the position of the vehicle in a turn, and to anticipate his or her preferred line through the turn.

It will be appreciated that the holographic sight need not be contained within a housing. Alternatively, the holographic reticle pattern can be projected onto a portion of the windshield of the vehicle or on any other substantially transparent surface between the operator and the intended target. To this end, the holographic reticle pattern can be projected onto a glass shield of a helmet worn by the operator. However, in view of factors such as cost and operator comfort, the use of holographic sights such as are available from EOTech, Inc. is presently most preferred.

The present invention also provides a method of applying road marking material to a pavement surface. The method comprises: providing a steerable vehicle having a holographic sight and at least one road marking material applicator mounted thereon; steering the vehicle to a desired position on the pavement surface based upon aiming information observable by an operator through the holographic sight; and dispensing road marking material through the road marking material applicator to the pavement surface. The holographic sight comprises a laser diode that emits a beam of visible wavelength light and a hologram of a reticle pattern mounted in the path of the beam to project a reticle pattern to a target plane. The aiming information viewable by an operator through the holographic sight comprises the projected reticle pattern and a ground target ahead of the vehicle.

The apparatus and method according to the present invention advantageously provide an aiming system that avoids all of the drawbacks of currently used systems. The holographic sight very quickly provides aiming information to the operator that the operator can use to adjust, as necessary, the direction of the vehicle and thus the position of the road marking material applicators with respect to the pavement surface. The holographic sight can be configured to project additional information to the operator such as, for example, the road marking material application rate and material balance. Operation of the apparatus and method of the invention do not interfere with oncoming traffic, can be used at any range, have no parallax, and do not require that the operator keep his or her head in a fixed position for extended periods of time, which leads to fatigue and error. Furthermore, the holographic reticle image does not disappear in high or low light conditions and is not compromised by the reflectivity of the intended target.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. An apparatus for applying road marking material to a pavement surface, the apparatus comprising:

a vehicle having at least one road marking material applicator mounted thereon; and a holographic sight mounted to the vehicle;

wherein the holographic sight comprises: a laser diode that emits a beam of visible wavelength light; and a hologram of a reticle pattern mounted in the path of the beam to project a reticle pattern to a target plane.

2. The apparatus according to claim 1 wherein the holographic sight further comprises:

a collimator mounted in the path of the beam to collimate the beam and direct the beam from the laser diode; and a reflective diffraction grating mounted in the path of the collimated beam to diffract the beam and directed the diffracted beam to the hologram.

3. The apparatus according to claim 2 wherein the laser diode, hologram, collimator and reflective diffraction grating are contained within a housing.

4. The apparatus according to claim 3 wherein the housing is secured to a windshield of the vehicle using a suction cup.

5. The apparatus according to claim 1 wherein the reticle pattern is projected on a portion of a windshield of the vehicle.

6. The apparatus according to claim 1 wherein the road marking applicator dispenses paint, thermoplastic and/or glass beads.

7. A method of applying road marking material to a pavement surface, the method comprising:

providing a steerable vehicle having a holographic sight and at least one road marking material applicator mounted thereon;

steering the vehicle to a desired position on the pavement surface based upon aiming information observable by an operator through the holographic sight; and dispensing road marking material through the road marking material applicator to the pavement surface;

wherein the holographic sight comprises: a laser diode that emits a beam of visible wavelength light; and a hologram of a reticle pattern mounted in the path of the beam to project a reticle pattern to a target plane.

8. The method according to claim 7 wherein the aiming information viewable by an operator through the holographic sight comprises the projected reticle pattern and a ground target ahead of the vehicle.

9. The method according to claim 8 wherein the ground target comprises a mark applied to the pavement surface less than thirty days prior to the date when the road marking material is dispensed.

10. The method according to claim 8 wherein the ground target comprises a mark applied to the pavement surface thirty days or more prior to the date when the road marking material is dispenses.

11. An apparatus for applying road marking material to a pavement surface, the apparatus comprising:

a vehicle having at least one road marking material applicator mounted thereon; and a holographic sight mounted to the vehicle, the holographic sight including: a laser that emits a beam of visible wavelength light; and a hologram of a reticle pattern mounted in the path of the beam to project a reticle pattern to a target plane.

12. The apparatus according to claim 11 wherein the holographic sight further comprises:

a collimator mounted in the path of the beam to collimate the beam and direct the beam from the laser; and a reflective diffraction grating mounted in the path of the collimated beam to diffract the beam and directed the diffracted beam to the hologram.

13. The apparatus according to claim 11 wherein the reticle pattern is projected on a portion of the vehicle.

14. A method of applying road marking material to a pavement surface, the method comprising:

providing a steerable vehicle having a holographic sight and at least one road marking material applicator mounted thereon;

steering the vehicle to a desired position on the pavement surface based upon aiming information observable by an operator through the holographic sight; and dispensing road marking material through the road marking material applicator to the pavement surface, the holographic sight including a laser that emits a beam of visible wavelength light; and a hologram of a reticle pattern mounted in the path of the beam to project a reticle pattern to a target plane.

15. The method according to claim 14 wherein the aiming information viewable by an operator through the holographic sight comprises the projected reticle pattern and a ground target ahead of the vehicle.

16. The method according to claim 15 wherein the ground target comprises a mark applied to the pavement surface less than thirty days prior to the date when the road marking material is dispensed.

17. A method of guiding the application of a road marking material to a pavement surface using a steerable vehicle having a holographic sight and at least one road marking material applicator mounted thereon, the holographic sight including a laser that emits a beam of visible wavelength light; and a hologram of a reticle pattern mounted in the path of the beam to project a reticle pattern to a target plane, the method comprising:

observing aiming information through the holographic sight; and steering the vehicle to a desired position on the pavement surface based upon the observed aiming information and, if necessary, adjusting a direction of the vehicle and a position of the road marking material applicator with respect to the pavement surface to achieve the desired position such that the road marking material can be dispensed through the road marking material applicator to the pavement surface.

18. The method according to claim 17 wherein the aiming information viewable by an operator through the holographic sight comprises the projected reticle pattern and a ground target ahead of the vehicle.

19. An apparatus for applying road marking material to a pavement surface, the apparatus comprising:

a vehicle having at least one road marking material applicator mounted thereon; and a holographic sight mounted to the vehicle;

wherein the holographic sight comprises a hologram of a reticle pattern mounted in the path of the beam to project a reticle pattern to a target plane.

20. The apparatus of claim 19, wherein the holographic sight further comprises a laser that emits a beam of visible wavelength light.

* * * * *